US009462651B2

(12) United States Patent
Reynolds et al.

(10) Patent No.: US 9,462,651 B2
(45) Date of Patent: Oct. 4, 2016

(54) THREE-WAY SOLID-STATE LIGHT BULB

(71) Applicant: Cree, Inc., Durham, NC (US)

(72) Inventors: Matthew C. Reynolds, Chapel Hill, NC (US); Michael McIntyre, Chapel Hill, NC (US)

(73) Assignee: Cree, Inc., Durham, NC (US)

( * ) Notice: Subject to any disclaimer, the term of this patent is extended or adjusted under 35 U.S.C. 154(b) by 131 days.

(21) Appl. No.: 14/223,324

(22) Filed: Mar. 24, 2014

(65) Prior Publication Data

US 2015/0271888 A1 Sep. 24, 2015

(51) Int. Cl.

| | |
|---|---|
| ***H05B 37/02*** | (2006.01) |
| ***H05B 33/08*** | (2006.01) |
| ***F21K 99/00*** | (2016.01) |

(52) U.S. Cl.

CPC ..... *H05B 33/0851* (2013.01); *F21K 9/135* (2013.01); *H05B 33/0821* (2013.01); *H05B 37/02* (2013.01)

(58) Field of Classification Search

CPC ..... H05B 33/0851; H05B 33/0881; H05B 37/02

USPC ..... 315/200 R, 291, 394, 297, 307, 308

See application file for complete search history.

(56) References Cited

U.S. PATENT DOCUMENTS

| | | | |
|---|---|---|---|
| 3,581,162 | A | 5/1971 | Wheatley |
| 5,463,280 | A | 10/1995 | Johnson |
| 5,561,346 | A | 10/1996 | Byrne |
| 5,585,783 | A | 12/1996 | Hall |
| 5,655,830 | A | 8/1997 | Ruskouski |
| 5,688,042 | A | 11/1997 | Madadi et al. |
| 5,806,965 | A | 9/1998 | Deese |
| 5,947,588 | A | 9/1999 | Huang |
| 5,949,347 | A | 9/1999 | Wu |
| 6,220,722 | B1 | 4/2001 | Begemann |
| 6,227,679 | B1 | 5/2001 | Zhang et al. |
| 6,234,648 | B1 | 5/2001 | Borner et al. |
| 6,250,774 | B1 | 6/2001 | Begemann et al. |
| 6,276,822 | B1 | 8/2001 | Bedrosian et al. |
| 6,465,961 | B1 | 10/2002 | Cao |
| 6,523,978 | B1 | 2/2003 | Huang |
| 6,550,953 | B1 | 4/2003 | Ichikawa et al. |
| 6,634,770 | B2 | 10/2003 | Cao |

(Continued)

FOREIGN PATENT DOCUMENTS

| | | | |
|---|---|---|---|
| EP | 1058221 | A2 | 12/2000 |
| EP | 0890059 | B1 | 6/2004 |

(Continued)

*Primary Examiner* — Tung X Le

(74) *Attorney, Agent, or Firm* — Steven B. Phillips; Moore & Van Allen PLLC

(57) ABSTRACT

A three-way solid-state light bulb is disclosed. Embodiments of the present invention provide power supply circuitry that allows a solid-state lamp or light bulb to work in a manner similar to that of a common three-way incandescent light bulb. The power supply can selectively receive the input voltage, usually AC line voltage, on first and second input terminals. In some embodiments, a control circuit is operable to influence a feedback loop by diverting current and/or in some cases alter a current sense resistance in accordance with the selective presence of the voltage at the first and second inputs. The light output of the solid-state emitter or solid-state emitters in the bulb is set in accordance with a selective presence of the input voltage.

21 Claims, 7 Drawing Sheets

(56) References Cited

U.S. PATENT DOCUMENTS

| | | | | |
|---|---|---|---|---|
| 6,659,632 | B2 | 12/2003 | Chen | |
| 6,709,132 | B2 | 3/2004 | Ishibashi | |
| 6,803,607 | B1 | 10/2004 | Chan et al. | |
| 6,848,819 | B1 | 2/2005 | Arndt et al. | |
| 6,864,513 | B2 | 3/2005 | Lin et al. | |
| 6,948,829 | B2 | 9/2005 | Verdes et al. | |
| 6,982,518 | B2 | 1/2006 | Chou et al. | |
| 7,048,412 | B2 | 5/2006 | Martin et al. | |
| 7,080,924 | B2 | 7/2006 | Tseng et al. | |
| 7,086,756 | B2 | 8/2006 | Maxik | |
| 7,086,767 | B2 | 8/2006 | Sidwell et al. | |
| 7,144,135 | B2 | 12/2006 | Martin et al. | |
| 7,165,866 | B2 | 1/2007 | Li | |
| 7,172,314 | B2 | 2/2007 | Currie et al. | |
| 7,354,174 | B1 | 4/2008 | Yan | |
| 7,396,142 | B2 | 7/2008 | Laizure, Jr. et al. | |
| 7,600,882 | B1 | 10/2009 | Morejon et al. | |
| 7,726,836 | B2 | 6/2010 | Chen | |
| 7,824,065 | B2 | 11/2010 | Maxik | |
| 8,021,025 | B2 | 9/2011 | Lee | |
| 8,198,819 | B2 * | 6/2012 | Lenk | H05B 33/0845 315/185 R |
| 8,253,316 | B2 | 8/2012 | Sun et al. | |
| 8,272,762 | B2 | 9/2012 | Maxik et al. | |
| 8,274,241 | B2 | 9/2012 | Guest et al. | |
| 8,277,082 | B2 | 10/2012 | Dassanayake et al. | |
| 8,282,250 | B1 | 10/2012 | Dassanayake et al. | |
| 8,292,468 | B2 | 10/2012 | Narendran et al. | |
| 8,322,896 | B2 | 12/2012 | Falicoff et al. | |
| 8,371,722 | B2 | 2/2013 | Carroll | |
| 8,400,051 | B2 | 3/2013 | Hakata et al. | |
| 8,415,865 | B2 | 4/2013 | Liang et al. | |
| 8,421,320 | B2 | 4/2013 | Chuang | |
| 8,421,321 | B2 | 4/2013 | Chuang | |
| 8,421,322 | B2 | 4/2013 | Carroll et al. | |
| 8,449,154 | B2 | 5/2013 | Uemoto et al. | |
| 8,502,468 | B2 | 8/2013 | Li et al. | |
| 8,641,237 | B2 | 2/2014 | Chuang | |
| 8,653,723 | B2 | 2/2014 | Cao et al. | |
| 8,696,168 | B2 | 4/2014 | Li et al. | |
| 8,740,415 | B2 | 6/2014 | Wheelock | |
| 8,750,671 | B1 | 6/2014 | Kelly et al. | |
| 8,752,984 | B2 | 6/2014 | Lenk et al. | |
| 8,760,042 | B2 | 6/2014 | Sakai et al. | |
| 9,006,997 | B2 * | 4/2015 | Shi | H05B 33/0848 315/291 |
| 2004/0201990 | A1 | 10/2004 | Meyer | |
| 2009/0184618 | A1 | 7/2009 | Hakata et al. | |
| 2012/0040585 | A1 | 2/2012 | Huang | |
| 2014/0152187 | A1 * | 6/2014 | Lin | H05B 33/0815 315/200 R |
| 2014/0312794 | A1 * | 10/2014 | Chen | H05B 33/0845 315/200 R |
| 2015/0002048 | A1 * | 1/2015 | Shi | H05B 33/0845 315/307 |
| 2015/0054410 | A1 * | 2/2015 | Sanders | H05B 33/0857 315/151 |
| 2015/0189721 | A1 * | 7/2015 | Karc | H05B 37/0272 315/250 |

FOREIGN PATENT DOCUMENTS

| | | | |
|---|---|---|---|
| GB | 2345954 | A | 7/2000 |
| JP | H09265807 | A | 10/1997 |
| JP | 2000173304 | A | 6/2000 |
| JP | 2001118403 | A | 4/2001 |
| WO | 0124583 | A1 | 4/2001 |
| WO | 0160119 | A2 | 8/2001 |
| WO | 2012011279 | A1 | 1/2012 |
| WO | 2012031533 | A1 | 3/2012 |

* cited by examiner

THREE-WAY SOLID-STATE LIGHT BULB

BACKGROUND

Light emitting diode (LED) lighting systems are becoming more prevalent as replacements for existing lighting systems. LEDs are an example of solid-state lighting (SSL) and have advantages over traditional lighting solutions such as incandescent and fluorescent lighting because they use less energy, are more durable, operate longer, can be combined in multiple color arrays that can be controlled to deliver virtually any color light, and generally contain no lead or mercury. In many applications, one or more LED dies (or chips) are mounted within an LED package or on an LED module, which may make up part of a lighting unit, lamp, "light bulb" or more simply a "bulb," which includes one or more power supplies to power the LEDs.

An LED bulb may be made with a form factor that allows it to replace a standard incandescent bulb, or any of various types of fluorescent lamps. For example, an LED bulb may be made in the form of an A-series, or "Edison" style incandescent bulb with a threaded base. Such an LED bulb can be used in a floor lamp or a table lamp of the type that might be placed on an end table or bed-side table. Some such lamps include so-called "three-way" sockets intended to receive a "three-way" incandescent bulb of the type shown in FIG. 1. Bulb 100 of FIG. 1 includes medium wattage filament 102 and low wattage filament 104. The outside of base 106 is a neutral terminal, and input terminals 108 and 110 reside near the bottom of base 106. Lamp 100 has three brightness settings, a low setting when filament 104 is energized, a medium setting when filament 102 is energized, and a high setting when both are energized.

SUMMARY

Embodiments of the present invention provide power supply circuitry that allows a solid-state lamp or light bulb to work in a manner similar to that of a common three-way incandescent light bulb. In at least some embodiments, circuitry is added to a driver (sometimes itself referred to as a power supply or a controller) to interpret the incoming AC line voltage and adjust the driver current for a solid-state emitter such as an LED.

In at least some embodiments, the power supply for the light bulb includes first and second inputs for receiving the line or input voltage relative to neutral, and a control circuit connected to the first and second inputs and a feedback input for a driver. The control circuit can selectively set a light output for the solid-state light emitter by influencing the feedback loop in accordance with the selective presence of the voltage at the first and second inputs. In a three-way lamp or bulb, the voltage inputs are connected to physical terminals, which along with a neutral terminal engage with terminals in a socket, lamp, light fixture, or the like.

In at least some embodiments, the control circuit selectively sets the light output by using a feedback input to set a regulation point for the driver. In at least some embodiments, the control circuit is operable to divert current from a feedback loop in accordance with the selective presence of the voltage at the first and second inputs. In at least some embodiments, the control circuit is operable to alter a current sense resistance for the solid-state emitter or LED in accordance with the selective presence of the voltage at the first and second inputs.

In some embodiments the circuit for setting light output in accordance with a selective presence of a voltage at a plurality of line inputs includes a feedback path for connection between a light emitter and a feedback input of a driver, a sensing circuit block connected to each of the plurality of line inputs to sense the voltage, and a control circuit block for each sensing block, each control circuit block connected to the feedback path to influence a regulation point for the driver in accordance with the presence of the voltage. A sensing circuit block and control circuit block can be used for each of as many line voltage inputs as desired to provide as many light levels as desired. If there are only two line inputs or the line inputs are otherwise organized in pairs, a pair of transistors can be provided, each transistor associated with the control circuit block and sensing circuit block for the input.

In some embodiments, transistors in the control circuit divert current in accordance with a sense voltage across a resistor. In some embodiments, transistors in the control circuit alter the current sense resistance. In some embodiments, transistors in the control circuit are connected in parallel. In some embodiments, transistors in the control circuit are connected in a cascode configuration.

In a three-way solid-state lamp according to at least some embodiments, the power supply selectively receives the input voltage, usually AC line voltage, on the first and second input terminals. The light output of the solid-state emitter or solid-state emitters is then set in accordance with a selective presence (for example, presence or absence on each input terminal) of the input voltage by causing the driver to supply power to enable the solid-state emitter or solid-state emitters to provide the light output in accordance with the input voltage.

BRIEF DESCRIPTION OF THE DRAWINGS

FIG. 1 includes the power supply portion of the bulb presented with a cut-away section of the housing to reveal the power supply circuitry inside the bulb.

DETAILED DESCRIPTION

Figure 1:
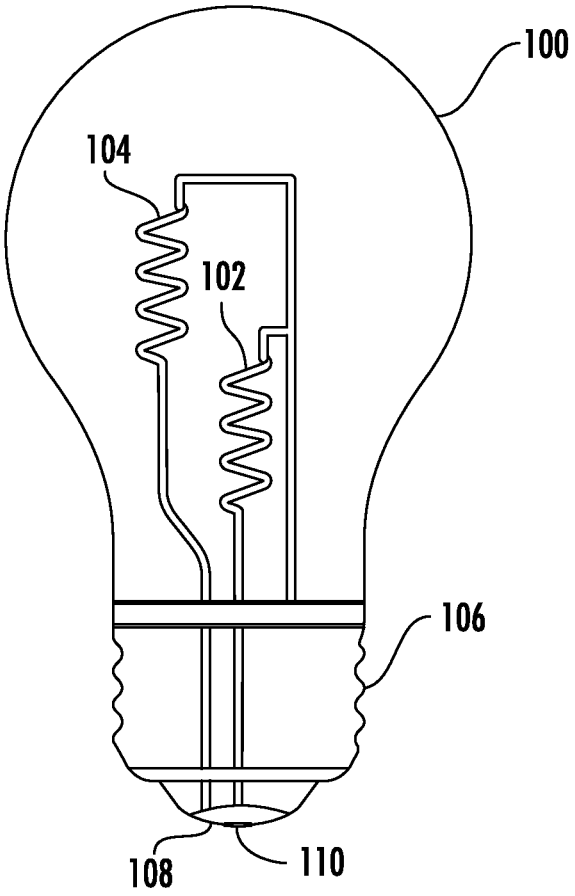
FIG. 1 PRIOR ART
FIG. 1 is a schematic illustration of a three-way incandescent light bulb.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

The terms "LED" and "LED device" as used herein may refer to any solid-state light emitter. The terms "solid-state light emitter" or "solid-state emitter" may include a light emitting diode, laser diode, organic light emitting diode, and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive materials. A solid-state lighting device produces light (ultraviolet, visible, or infrared) by exciting electrons across the band gap between a conduction band and a valence band of a semiconductor active (light-emitting) layer, with the electron transition generating light at a wavelength that depends on the band gap. Thus, the color (wavelength) of the light emitted by a solid-state emitter depends on the materials of the active layers thereof. In various embodiments, solid-state light emitters may have peak wavelengths in the visible range and/or be used in combination with lumiphoric materials having peak wavelengths in the visible range. Multiple solid-state light emitters and/or multiple lumiphoric materials (i.e., in combination with at least one solid-state light emitter) may be used in a single device, such as to produce light perceived as white or near-white in character. In certain embodiments, the aggregated output of multiple solid-state light emitters and/or lumiphoric materials may generate warm white light output having a color temperature range of from about 2700K to about 4000K.

Solid-state light emitters may be used individually or in combination with one or more lumiphoric materials (e.g., phosphors, scintillators, lumiphoric inks) and/or optical elements to generate light at a peak wavelength, or of at least one desired perceived color (including combinations of colors that may be perceived as white). Inclusion of lumiphoric (also called 'luminescent') materials in lighting devices as described herein may be accomplished by direct coating on solid-state light emitter, adding such materials to encapsulants, adding such materials to lenses, by embedding or dispersing such materials within lumiphor support elements, and/or coating such materials on lumiphor support elements. Other materials, such as light scattering elements (e.g., particles) and/or index matching materials may be associated with a lumiphor, a lumiphor binding medium, or a lumiphor support element that may be spatially segregated from a solid-state emitter.

For purposes of the discussion herein, the term "power supply" is used to refer to the circuitry that receives line input voltage and ultimately supplies power to solid-state emitters in a lamp or bulb. The term "driver" is used to refer to the portion of that circuitry that includes feedback compensation and a controller that is typically used in solid-state lamps. Thus, the term "power supply" is typically going to be used to refer to circuitry inclusive of the control circuit discussed in detail herein, whereas the term "driver" will be used to discuss circuitry exclusive of the control circuit. The terms "input" and "output" refer to input and output circuit paths. However, when used with the term "terminal" these terms are meant to refer to physical connections of a device such as a solid-state lamp or bulb.

Embodiments of the present invention provide power supply circuitry that allows a solid-state lamp or light bulb to work in a manner similar to that of a common three-way incandescent light bulb. In the case of the example LED light bulbs discussed herein, a control circuit is connected to an electronic LED driver (sometimes called a "controller") to interpret the incoming AC line voltage (absence or presence) and adjust the LED current accordingly. The light output is adjusted depending on which AC input terminal(s) is (are) energized. This adjustment is accomplished by changing (manipulating) the LED driver's regulation point, either the voltage or current regulation point. With proper design of the circuitry, the LED bulb can mimic the light output of a traditional three-way incandescent light bulb as related to switch positions of a fixture or socket. Alternatively, the design can be altered to produce some other light output for specific combinations of voltages on the inputs. The table below illustrates the logic of adjusting the light output based on the presence or absence of AC line voltage on two input terminals, referred to as "AC Voltage #1" and "AC Voltage #2."

| AC voltage presence vs. light output | | | | |
|---|---|---|---|---|
| Light Output | zero | low | medium | high |
| AC Voltage #1 | off | present | off | present |
| AC Voltage #2 | off | off | present | present |

Figure 2:
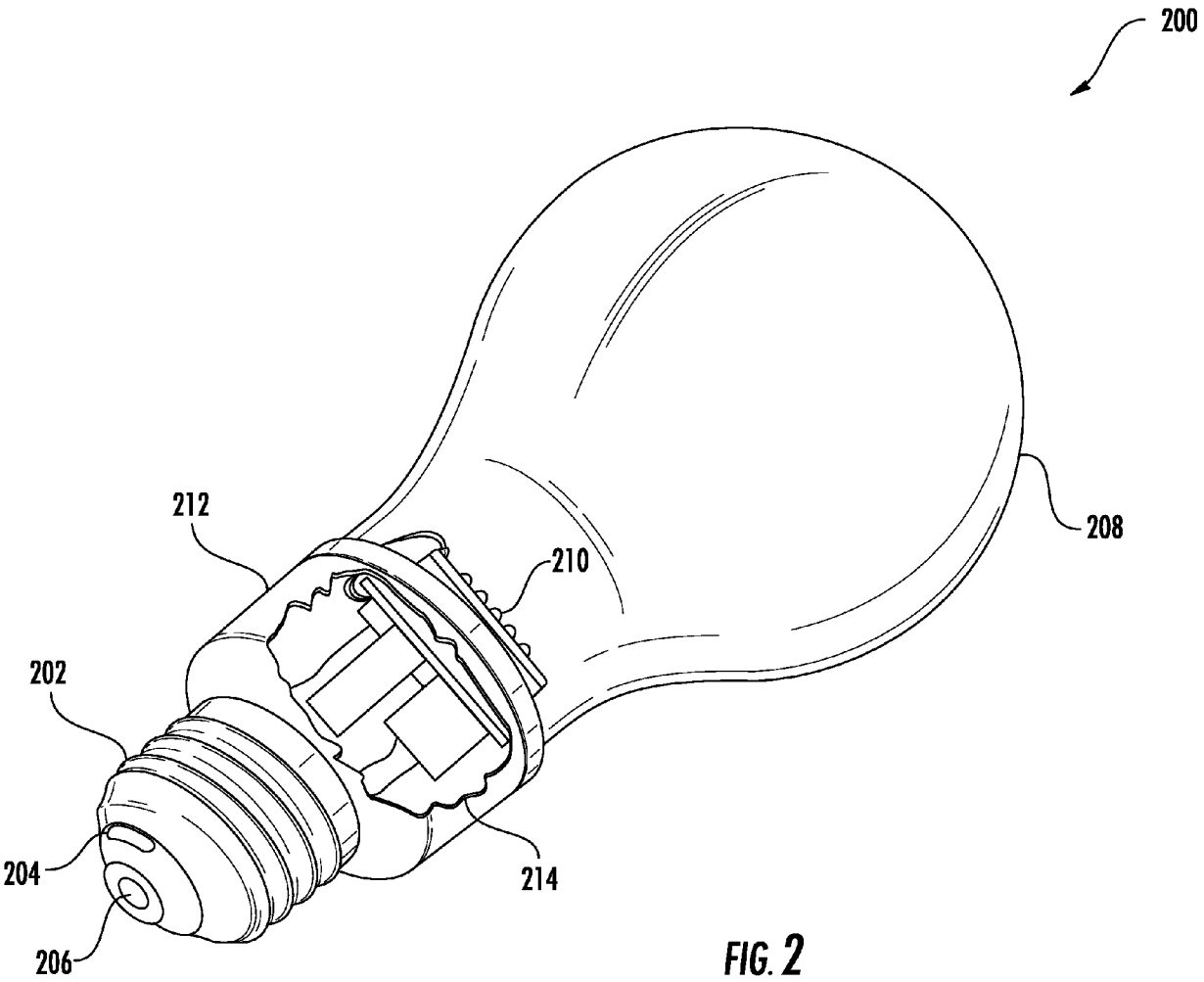
FIG. 2 illustrates a perspective view of a three-way LED light bulb according to example embodiments of the invention.

FIG. 2 is a perspective view of LED light bulb 200. LED light bulb 200 includes an Edison style base 202 with input terminals 204 and 206 to selectively provide AC line voltage to the power supply of the bulb. This arrangement of a screw-in base with two voltage terminals wherein the metal threaded surface on the base serves as a neutral terminal is recognizable as similar to that of a standard three-way incandescent light bulb. In this particular example, bulb 200 includes an optical enclosure 208 and a plurality of LEDs 210. The power supply for the bulb resides in housing 212 and the various electronic components of the power supply are visible through opening 214 where the housing has been cut away.

Figure 3:
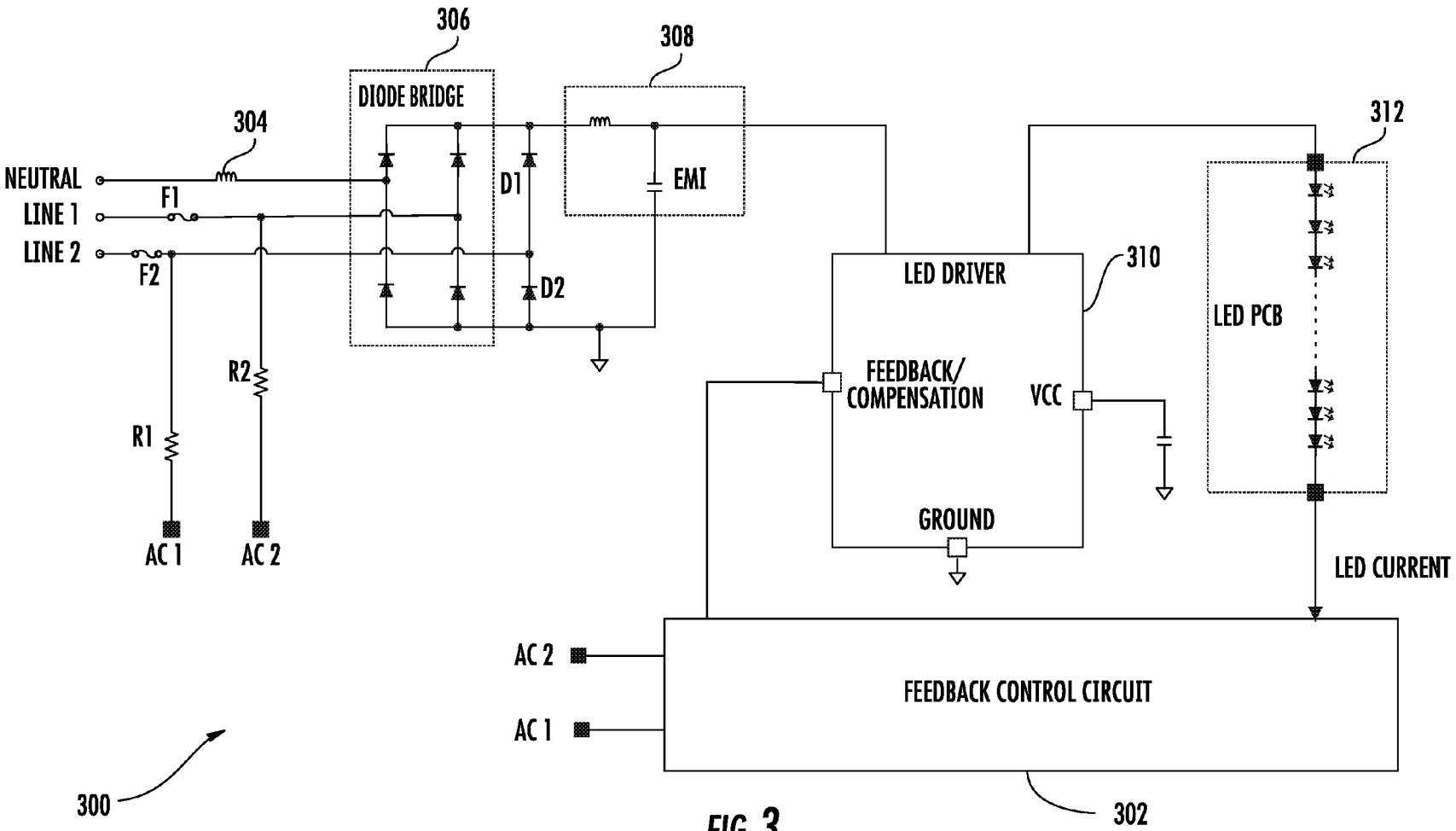
FIG. 3 is a schematic diagram of the power supply for an LED light bulb according to example embodiments of the invention.

FIG. 3 is a schematic block diagram of the power supply 300 of the example LED light bulb of FIG. 2. The first and second voltage inputs to the power supply are labeled LINE-1 and LINE-2, and the neutral line is labeled NEUTRAL. The internal connections for the two input voltages are labeled AC 1 and AC 2. These input voltages are filtered by a combination of resistors R1 and R2, and additional components that are part of feedback control circuit 302, to be discussed in detail below. The neutral line is stabilized by inductor 304 and the voltage inputs are protected by fuses F1 and F2. The inputs to the circuit are further connected to diode bridge 306, diodes D1 and D2, and electromagnetic interference (EMI) filter 308. LED driver 310 provides power to the LEDs, which are mounted on LED board 312, which in turn is connected to the feedback control circuit 302, which is in turn connected not only to AC 1 and AC 2, but also to the feedback/compensation input of LED driver 310.

The driver in the example of FIG. 3 is based on a boost converter, but the feedback control circuit can be used with many LED driver types/topologies including buck converters, SEPIC converters, buck-boost converters and flyback converters. A "driver" is any circuitry or portion thereof that provides power to the LEDs, and the feedback signal is used to adjust how the LEDs are powered. Any LED driver that uses a regulation feedback loop is capable of being manipulated to mimic a three-way lamp as described can be used. The feedback control circuit changes the regulation point of the driver in order to alter either of both of the LED drive current and/or voltage The feedback control circuit 302 of FIG. 3 can be implemented in numerous ways. The control circuit can be implemented on a single chip as an integrated device. It can also be combined with the driver shown in FIG. 3 and made a part of a single integrated circuit. Alternatively, it can be assembled from discrete components. FIGS. 4, 5, 6, and 7 each illustrate an alternative design for the control circuit implemented by discrete components.

Figure 4:
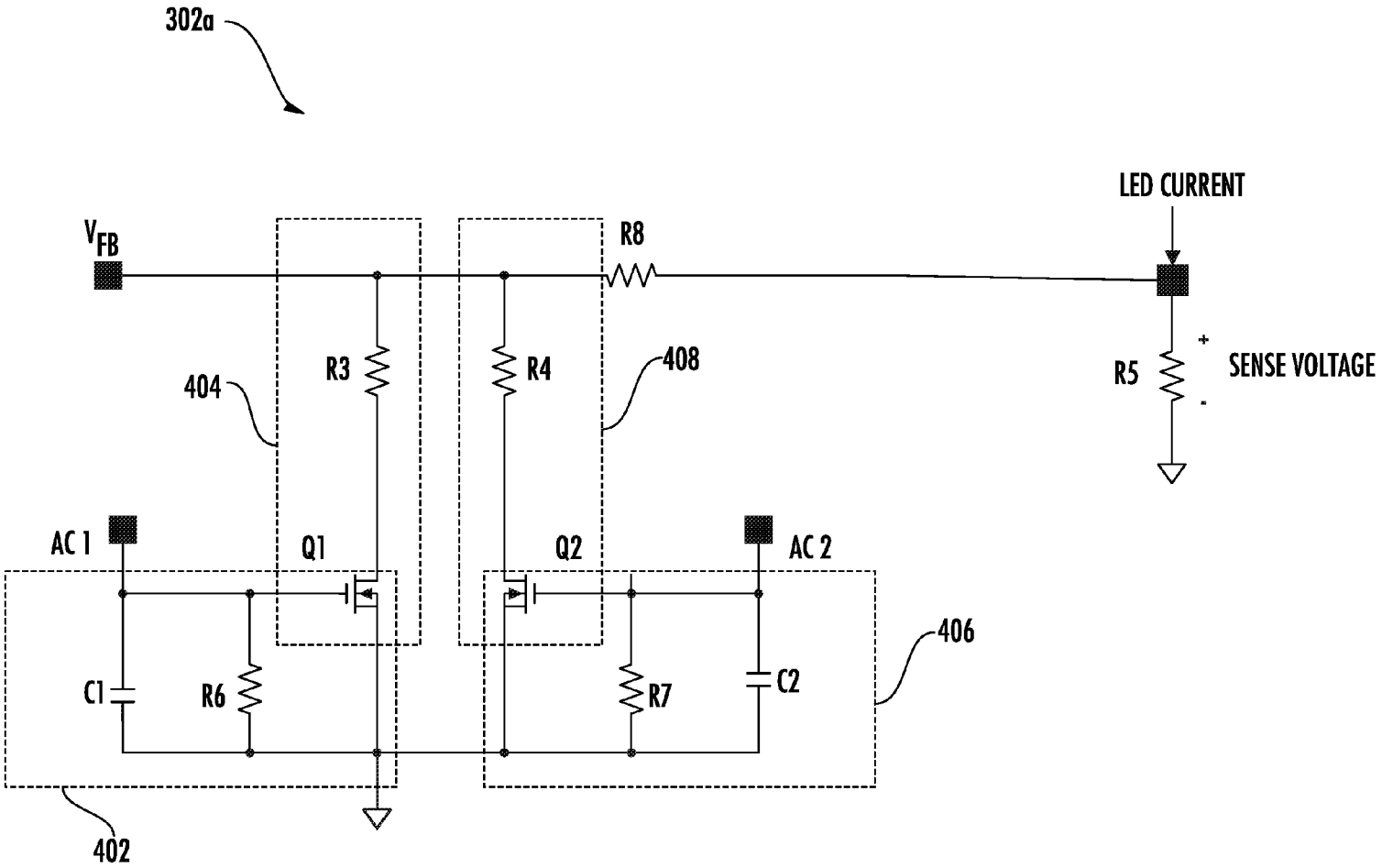
FIG. 4 is a schematic diagram of the control circuit of the power supply shown in FIG. 3 according to at least one example embodiment of the present invention.

With control circuit 302*a* of FIG. 4, the LED feedback loop is directly altered in accordance with the selective presence and/or absence of voltage at the first and second inputs, by effectively changing the values of resistors R3, R4, and R5. In this way, the control circuit diverts current from the feedback loop. The presence of incoming AC line voltage (both inputs) is detected and filtered with resistors R1, R2, R6, and R7 as well as capacitors C1 and C2. R5 serves as a sense resistor to provide a sense voltage. Resistor R8 has a much greater resistance value than sense resistor R5. The increased impedance between the sense voltage across resistor R5 and the driver's feedback sense point at the feedback/compensation input allows transistors Q1 and Q2 to manipulate the feedback loop of the driver by diverting a small amount of current in and/or out of the feedback/compensation input for the driver. The connection to the feedback/compensation input of the driver is labeled $V_{FB}$. If and when AC line voltage is present, voltage on the gate of the corresponding MosFET, Q1 and/or Q2, will turn on the MosFET. If the incoming AC line voltage is not present, the corresponding MosFET(s) will remain off. By switching the transistors on and off the feedback loop of the LED driver is manipulated. The light output of the LEDs is determined by how much the feedback loop is changed.

The control circuit 302*a* of FIG. 4 is organized into circuit blocks. A sensing circuit block 402 is formed from Q1, R6, and C1 and a control circuit block 404 is formed from Q1 and R3. A sensing circuit block 406 is formed from Q2, R7, and C2 and a control circuit block 408 is formed from Q2 and R4. Multiple sensing and control circuit blocks could be used to accommodate as many line voltage inputs as desired. The table below shows the sense current for the three light outputs for a solid-state bulb that is designed to work like a standard three-way incandescent bulb using control circuit 302*a*.

| Light Output | Active current sense |
|---|---|
| Low | $i_{LOW} = \frac{V_{FB}}{R4}$ |
| Medium | $i_{MID} = \frac{V_{FB}}{R3}$ |
| High | $i_{HIGH} = V_{FB}\left[\frac{R3 + R4}{R3 \times R4}\right]$ |

Figure 5:
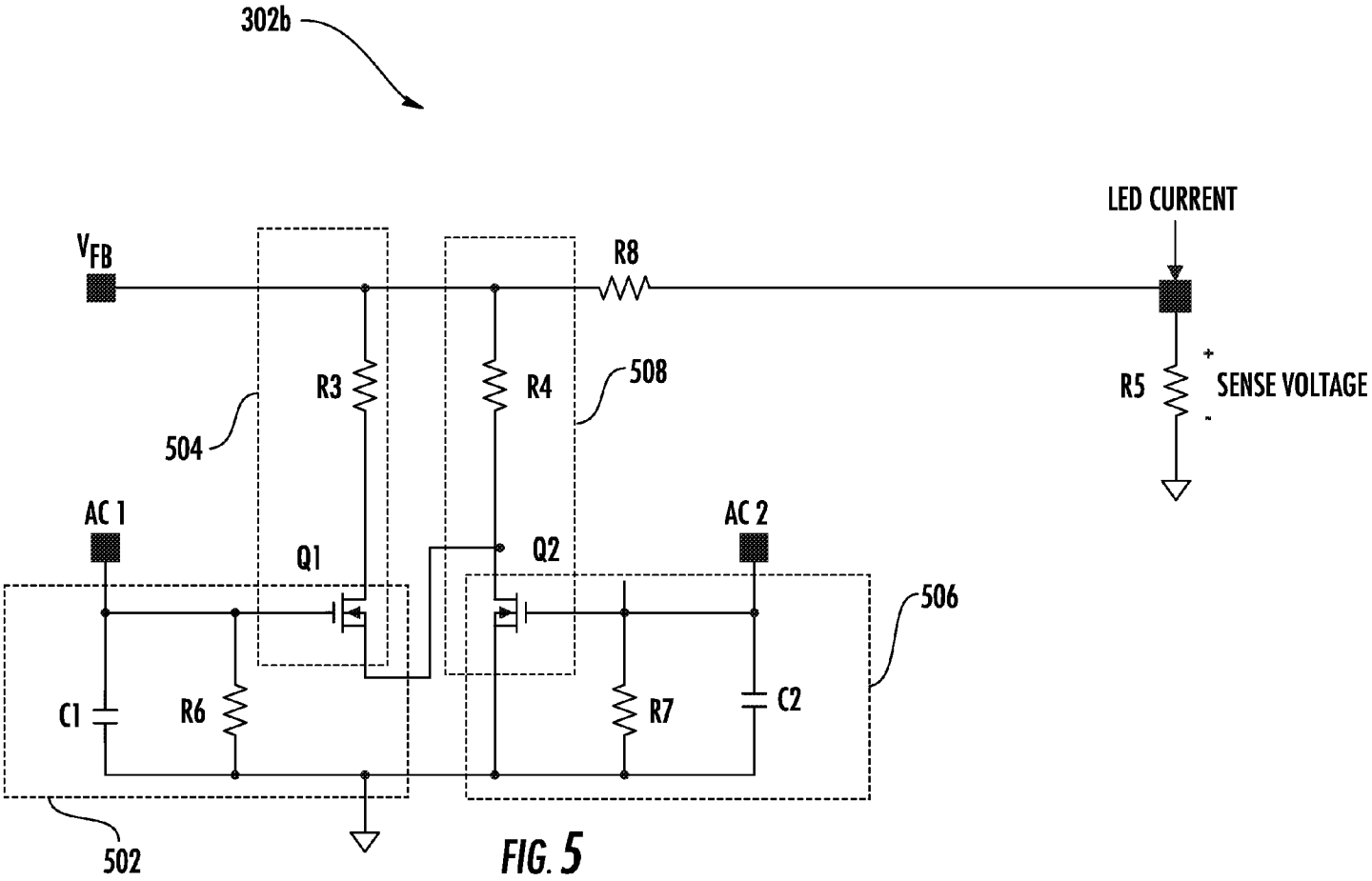
FIG. 5 is a schematic diagram of the control circuit of the power supply shown in FIG. 3 according to another example embodiment of the present invention.

FIG. 5 shows a control circuit 302*b* according to another embodiment. The control circuitry is similar in many respects to the circuit previously described. The circuit adjusts the current regulation feedback loop in a similar way; however, Q1 is configured as a cascode MosFET, with the source of Q1 connected to the drain of Q2. The cascode configuration allows for greater flexibility manipulating the driver's feedback loop.

The control circuit 302*b* of FIG. 5 is organized into circuit blocks. A sensing circuit block 502 is formed from Q1, R6, and C1 and a control circuit block 504 is formed from Q1 and R3. A sensing circuit block 506 is formed from Q2, R7, and C2 and a control circuit block 508 is formed from Q2 and R4. As before, multiple sensing and control circuit blocks could be used to accommodate as many line voltage inputs as desired. The table below shows the sense current for the three light outputs for a solid-state bulb that is designed to work like a standard three-way incandescent bulb using control circuit 302*b*.

| Light Output | Active current sense |
|---|---|
| Low | $i_{LOW} = \frac{V_{FB}}{R5}$ |
| Medium | $i_{MID} = V_{FB}\left(\frac{(R8+R4)}{(R5\times R4)}\right)$ |
| High | $i_{High} = V_{FB}\left(\frac{(R8\times R4)+(R8\times R3)+(R3\times R4)}{(R5\times R4\times R3)}\right)$ |

Figure 6:
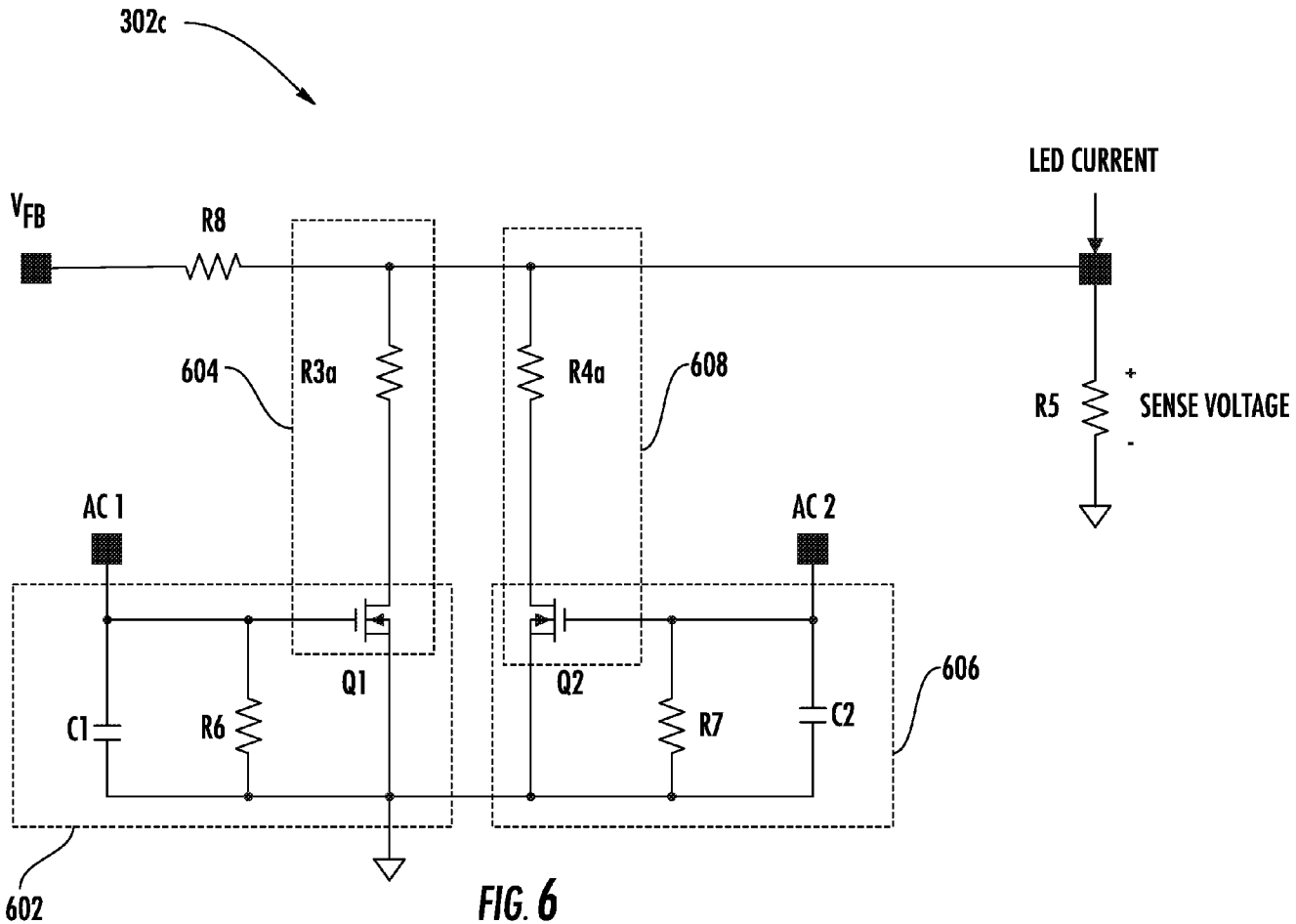
FIG. 6 is a schematic diagram of the control circuit of the power supply shown in FIG. 3 according to an additional example embodiment of the present invention.

FIG. 6 shows a control circuit 302*c* according to an additional example embodiment. Resistor R8 is located on the other side of resistors R1 and R2. In this example embodiment, the light output is changed by altering the LED current sense resistance. This altering of the current sense resistance is accomplished by inserting or removing resistors R3*a* and R4*a* using MosFETs Q1 and Q2 respectively in accordance with the selective presence (presence or absence) of voltage at the first and second inputs. In this circuit, R3*a* and R4*a* have much lower resistance values than R3 and R4 of the previously described embodiments.

Staying with FIG. 6, by placing resistor R3*a* and/or R4*a* into the circuit, the parallel resistance seen as the sense voltage will decrease. The driver will increase the output current through the LEDs until a regulated sense voltage is seen. Decreasing the effective sense resistance (MosFET on) increases the driver's output current and hence the light output. Increasing effective sense resistance (MosFET off) decreases current through LEDs and decreases light output.

The control circuit 302*c* of FIG. 6 can be organized into circuit blocks as previously described. In the case of FIG. 6, a sensing circuit block 602 is formed from Q1, R6, and C1 and a control circuit block 604 is formed from Q1 and R3*a*. A sensing circuit block 606 is formed from Q2, R7, and C2 and a control circuit block 608 is formed from Q2 and R4*a*. Multiple sensing and control circuit blocks could be used. The table below shows the sense current for the three light outputs for a solid-state bulb that is designed to work like a standard three-way incandescent bulb using control circuit 302*c*.

| Light Output | Active current sense |
|---|---|
| Low | $I_{R4a}$ |
| Medium | $I_{R3a}$ |
| High | $I_{R4a} + I_{R3a}$ |

Figure 7:
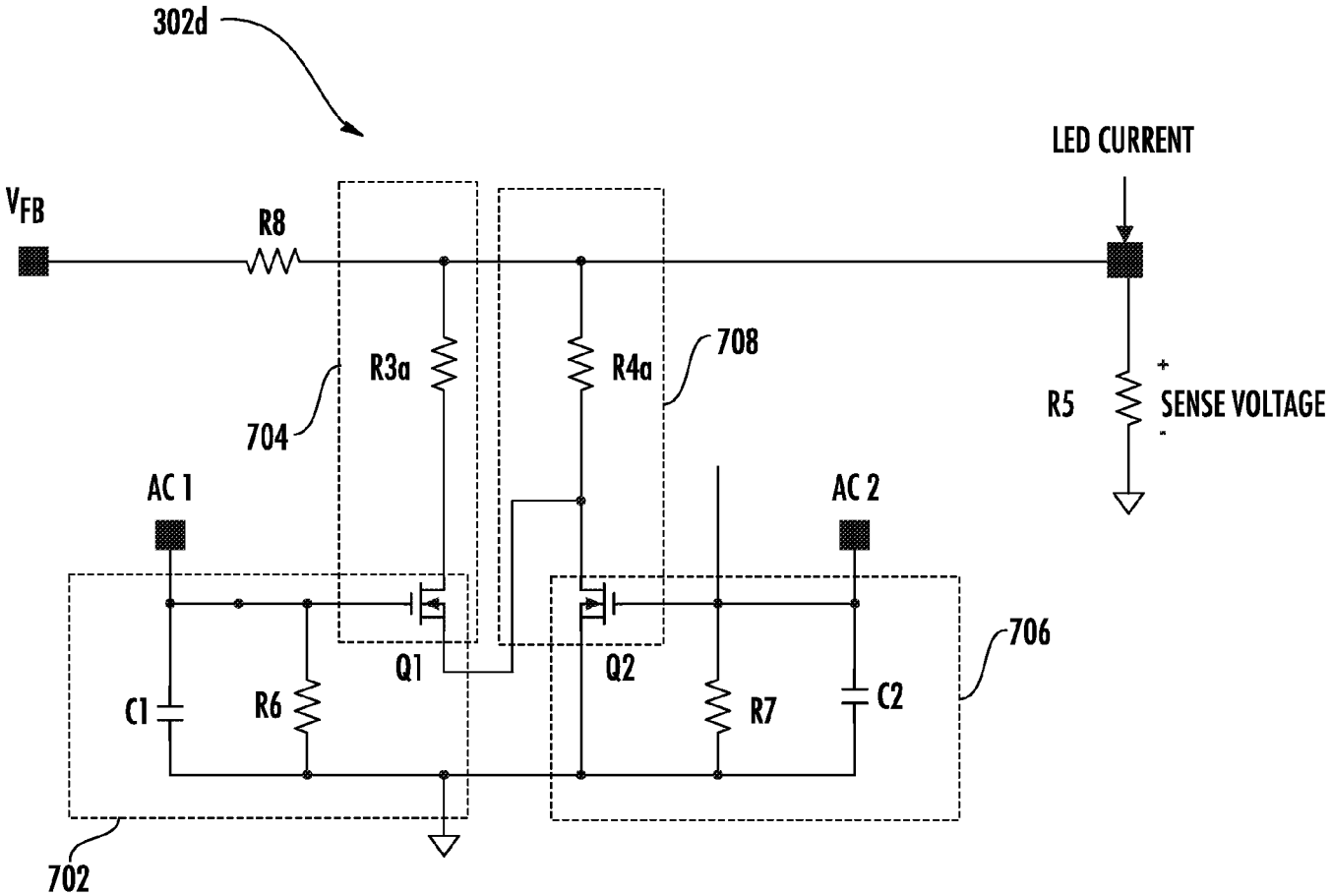
FIG. 7 is a schematic diagram of the control circuit of the power supply shown in FIG. 3 according to yet another example embodiment of the present invention.

FIG. 7 shows a control circuit 302*d* according to another embodiment. The control circuitry is similar in many respects to the circuit described immediately above. Control circuit 302*d* uses a cascode MosFET configuration instead of a having the MosFETs connected in parallel. This configuration allows for greater variations in LED drive current than does the circuit described immediately above.

As before, the control circuit 302*d* of FIG. 7 is organized into circuit blocks. A sensing circuit block 702 is formed from Q1, R6, and C1 and a control circuit block 704 is formed from Q1 and R3*a*. A sensing circuit block 706 is formed from Q2, R7, and C2 and a control circuit block 708 is formed from Q2 and R4*a*. Multiple sensing and control circuit blocks can again be used. The table below shows the sense current for the three light outputs for a solid-state bulb that is designed to work like a standard three-way incandescent bulb using control circuit 302*d*.

| Light Output | Active current sense |
|---|---|
| Low | $I_{R5}$ |
| Medium | $I_{R5} + I_{R4a}$ |
| High | $I_{R5} + I_{R4a} + I_{R3a}$ |

The example embodiments described can be "tuned" by alterations in resistor values, driver circuitry, and the like to create a three-way solid-state light bulb with various stepped light outputs to mimic various wattages of standard incandescent light bulbs, for example, bulbs providing 30/70/100, 40/60/100, or 50/100/150 watt equivalents. Non-standard lighting output configurations can also be created. For example, light output can be evenly stepped between the three settings as opposed to in the typical three-way incandescent bulb where the light outputs of two of the settings are fairly close together. It is also possible to have more than three settings by adding additional sense and control circuit blocks to the feedback control circuit.

The various portions of a solid-state lamp or bulb according to example embodiments of the invention can be made of any of various materials. Heat sinks can be made of metal or plastic, as can the various portions of the housings for the components of a lamp. A bulb according to embodiments of the invention can be assembled using varied fastening methods and mechanisms for interconnecting the various parts. For example, in some embodiments locking tabs and holes can be used. In some embodiments, combinations of fasteners such as tabs, latches or other suitable fastening arrangements and combinations of fasteners can be used which would not require adhesives or screws. In other embodiments, adhesives, screws, bolts, or other fasteners may be used to fasten together the various components.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A power supply for a solid-state light bulb, the power supply comprising:

first and second inputs for receiving a voltage;

an output for connection to a solid-state light emitter; and a control circuit connected to the first and second inputs and to a feedback input for a driver, to selectively adjust a light output among various light outputs for the solid-state light emitter by using the feedback input to divert current from a feedback loop to set a regulation point for the driver in accordance with a selective presence of the voltage at the first and second inputs.

2. The power supply of claim 1 wherein the control circuit further comprises two transistors to divert the current in accordance with a sense voltage across a resistor.

3. The power supply of claim 2 wherein the two transistors are connected in parallel.

4. The power supply of claim 2 wherein the two transistors are connected in a cascode configuration.

5. The power supply of claim 1 wherein the control circuit is operable to alter a current sense resistance for the solid-state emitter in accordance with the selective presence of the voltage at the first and second inputs.

6. The power supply of claim 5 wherein the control circuit further comprises two transistors to alter the current sense resistance in accordance with a sense voltage across a resistor.

7. The power supply of claim 6 wherein the two transistors are connected in parallel.

8. The power supply of claim 6 wherein the two transistors are connected in a cascode configuration.

9. A light emitting diode (LED) light bulb comprising:

first and second input terminals for receiving a voltage relative to a neutral terminal;

at least one LED; and a control circuit connected to the first and second input terminals, a feedback input for a driver, and the at least one LED to selectively adjust a light output among various light outputs of the at least one LED by a transistor connected to the feedback input to set a regulation point for the driver by altering a current sense resistance in accordance with a sense voltage corresponding to a selective presence of the voltage at the first and second input terminals.

10. The LED light bulb of claim 9 wherein the control circuit is operable to divert current from a feedback loop in accordance with the selective presence of the voltage at the first and second input terminals.

11. The LED light bulb of claim 10 wherein the at least one transistor comprises two transistors connected in parallel.

12. The LED light bulb of claim 10 wherein the at least one transistor comprises two transistors connected in a cascode configuration.

13. The LED light bulb of claim 9 wherein the at least one transistor comprises two transistors connected in parallel.

14. The LED light bulb of claim 9 wherein the at least one transistor comprises two transistors connected in a cascode configuration.

15. A method of operating an light emitting diode (LED) light bulb, the method comprising:

selectively receiving an input voltage on first and second input terminals relative to a neutral terminal;

selectively adjusting a light output from among various light outputs of at least one LED by altering a current sense resistance to divert current from a feedback loop to set a regulation point for a driver in accordance a sense voltage across the current sense resistance corresponding to a selective presence of the input voltage on the first and second input terminals; and causing the driver to supply power to the at least one LED to enable the at least one LED to provide the light output in accordance with the selective presence of the input voltage.

16. A circuit for setting light output in accordance with a selective presence of a voltage at a pair of line inputs, the circuit comprising:

a feedback path for connection between a light emitter and a feedback input of a driver;

a sensing circuit block connected to each of the pair of line inputs to sense the voltage at the line input;

a control circuit block for the sensing circuit block, the control circuit block connected to the feedback path to influence a regulation point for the driver in accordance with the presence of the voltage; and a sense resistor connected to the feedback path.

17. The circuit of claim 16 further comprising a pair of transistors, each transistor associated with the control circuit block and sensing circuit block of a line input.

18. The circuit of claim 17 further comprising the driver.

19. The circuit of claim 18 further comprising a light emitter connected to the driver and the feedback path.

20. The circuit of claim 17 wherein the pair of transistors are connected in parallel.

21. The circuit of claim 17 wherein the pair of transistors are connected in a cascode configuration.

* * * * *